US011619465B1

(12) United States Patent
Fazio

(10) Patent No.: US 11,619,465 B1
(45) Date of Patent: Apr. 4, 2023

(54) DRAW ALERTING WEAPON HOLSTERING DEVICE

(71) Applicant: Joe Fazio, Streetsboro, OH (US)

(72) Inventor: Joe Fazio, Streetsboro, OH (US)

( * ) Notice: Subject to any disclaimer, the term of this patent is extended or adjusted under 35 U.S.C. 154(b) by 0 days.

(21) Appl. No.: 17/553,240

(22) Filed: Dec. 16, 2021

(51) Int. Cl.
*F41C 33/02* (2006.01)

(52) U.S. Cl.
CPC ..... *F41C 33/029* (2013.01); *F41C 33/0227* (2013.01)

(58) Field of Classification Search
CPC ..... F41C 33/029; F41C 33/0227; F41C 33/0209; F41C 33/0263
See application file for complete search history.

(56) References Cited

U.S. PATENT DOCUMENTS

| | | | | |
|---|---|---|---|---|
| 5,546,124 | A | 8/1996 | Scerbo, III | |
| 9,140,509 | B2 | 9/2015 | Sullivan | |
| 11,073,352 | B1 * | 7/2021 | Radcliff | F41A 17/066 |
| 11,300,381 | B2 * | 4/2022 | Bernkrant | F41C 33/029 |
| 11,378,355 | B1 * | 7/2022 | Howard | G08B 5/36 |
| 2005/0035162 | A1 | 2/2005 | Lowe | |
| 2006/0208025 | A1 * | 9/2006 | Grundy | F41C 33/041 224/660 |
| 2015/0332604 | A1 | 11/2015 | Rich | |
| 2017/0010062 | A1 | 1/2017 | Black | |
| 2017/0074617 | A1 * | 3/2017 | Stewart | H04W 4/80 |
| 2018/0010884 | A1 * | 1/2018 | Bernkrant | F41C 33/0272 |
| 2018/0209761 | A1 * | 7/2018 | Erickson | F41C 33/0245 |

FOREIGN PATENT DOCUMENTS

| | | |
|---|---|---|
| WO | WO3054849 | 7/2003 |

* cited by examiner

*Primary Examiner* — Corey N Skurdal

(57) ABSTRACT

A draw alerting weapon holstering device for reducing weapon confusion includes a holster into which a weapon is insertable. The holster can be engaged either to a user or to an article that is engaged to the user. A housing is selectively engageable to or is integral to the holster. A detector, a speaker, a vibrator, and a microprocessor are engaged to the housing, with the latter two being positioned in the housing. A battery is selectively engageable to the housing. The detector can detect a weapon that is positioned in the holster. The microprocessor is operationally engaged to the battery and is communicatively engaged to the vibrator, the speaker, and the detector. The detector signals the microprocessor upon drawing of the weapon from the holster, whereupon the microprocessor selectively signals the speaker and the vibrator to broadcast an audible alert and to initiate a vibratory alert, respectively.

13 Claims, 8 Drawing Sheets

DRAW ALERTING WEAPON HOLSTERING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to holstering devices and more particularly pertains to a new holstering device for reducing weapon confusion. The present invention discloses a holstering device comprising a holster with a sensor, a speaker, and a vibrator, wherein the sensor can detect when a weapon is drawn from the holster, whereupon the speaker and the vibrator selectively broadcast an audible alert and initiate a vibratory alert, respectively.

(2) Description of Related Art Including Information Disclosed Under 37 CFR 1.97 and 1.98

The prior art relates to holstering devices. Prior art holstering devices may comprise holsters with speakers that signal when a weapon is inserted, holsters with cameras, and the like. What is lacking in the prior art is a holstering device comprising a holster with a sensor, a speaker, and a vibrator, wherein the sensor can detect when a weapon is drawn from the holster, whereupon the speaker and the vibrator selectively broadcast an audible alert and initiate a vibratory alert, respectively.

BRIEF SUMMARY OF THE INVENTION

An embodiment of the disclosure meets the needs presented above by generally comprising a holster, which is configured for insertion of a weapon and for engaging either a user or an article engaged to the user so that the holster and the weapon are engaged to the user. A housing is selectively engageable to or integral to the holster. A detector is engaged to the housing and is configured to detect a weapon that is positioned in the holster. A speaker is engaged to the housing. A vibrator is engaged to the housing and is positioned in an interior space defined by the housing. A battery is selectively engageable to the housing. A microprocessor is engaged to the housing and is positioned in the interior space. The microprocessor is operationally engaged to the battery and is communicatively engaged to the vibrator, the speaker, and the detector. The detector is enabled to signal the microprocessor upon drawing of the weapon from the holster, positioning the microprocessor to selectively signal the speaker and the vibrator to broadcast an audible alert and to initiate a vibratory alert, respectively.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
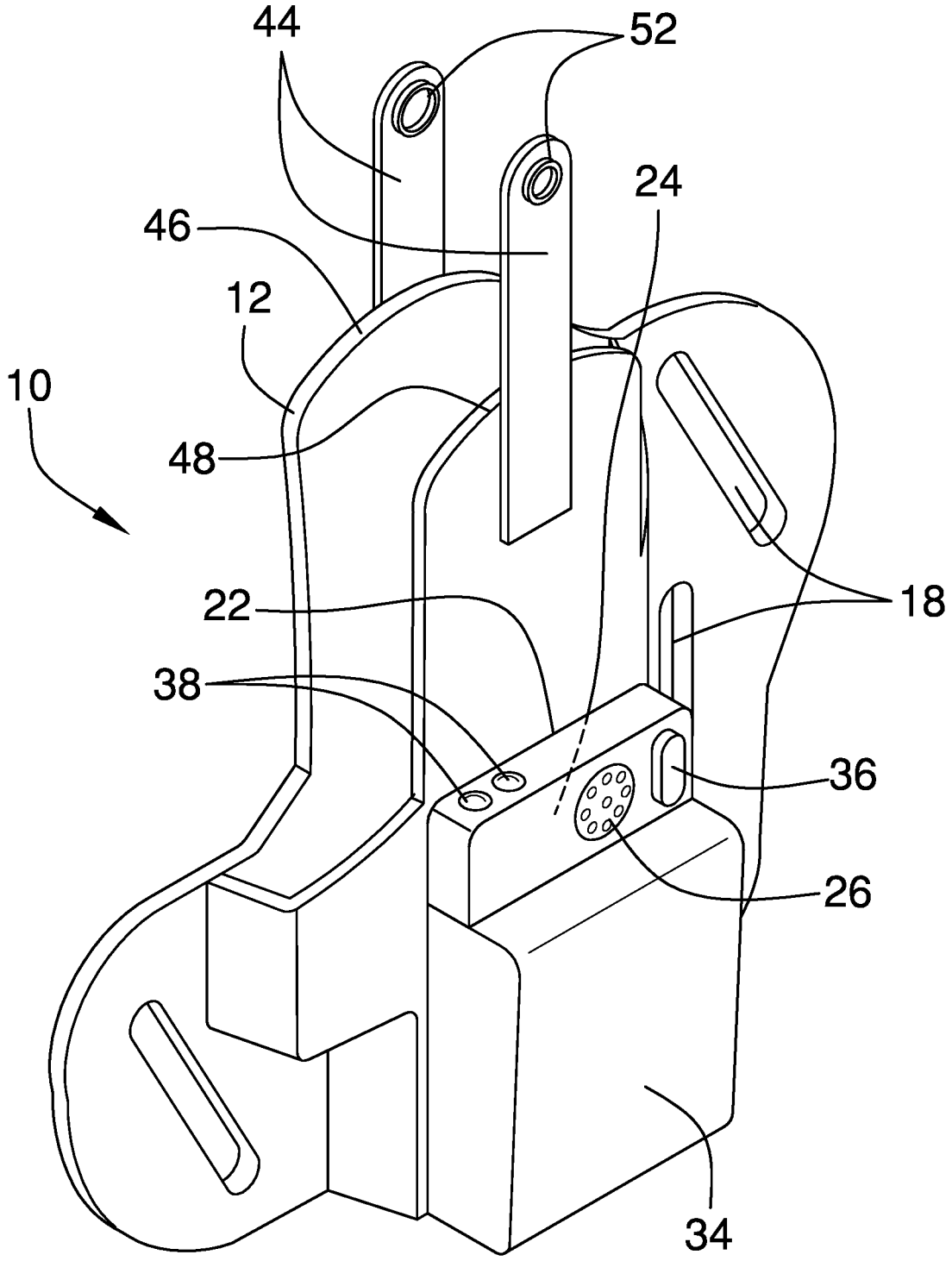
FIG. 1 is an isometric perspective view of a draw alerting weapon holstering device according to an embodiment of the disclosure.
Figure 2:
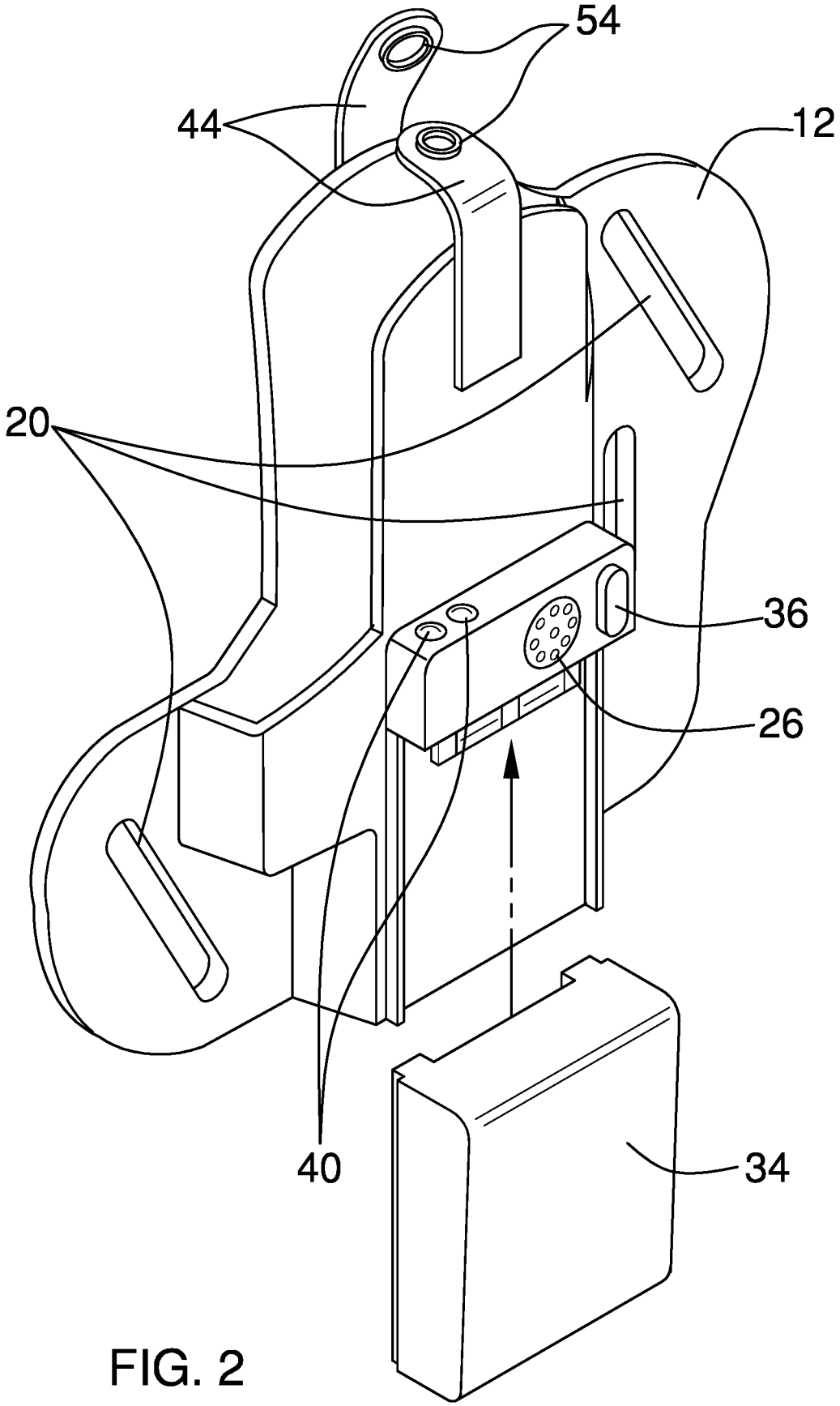
FIG. 2 is an isometric perspective view of an embodiment of the disclosure.
Figure 3:
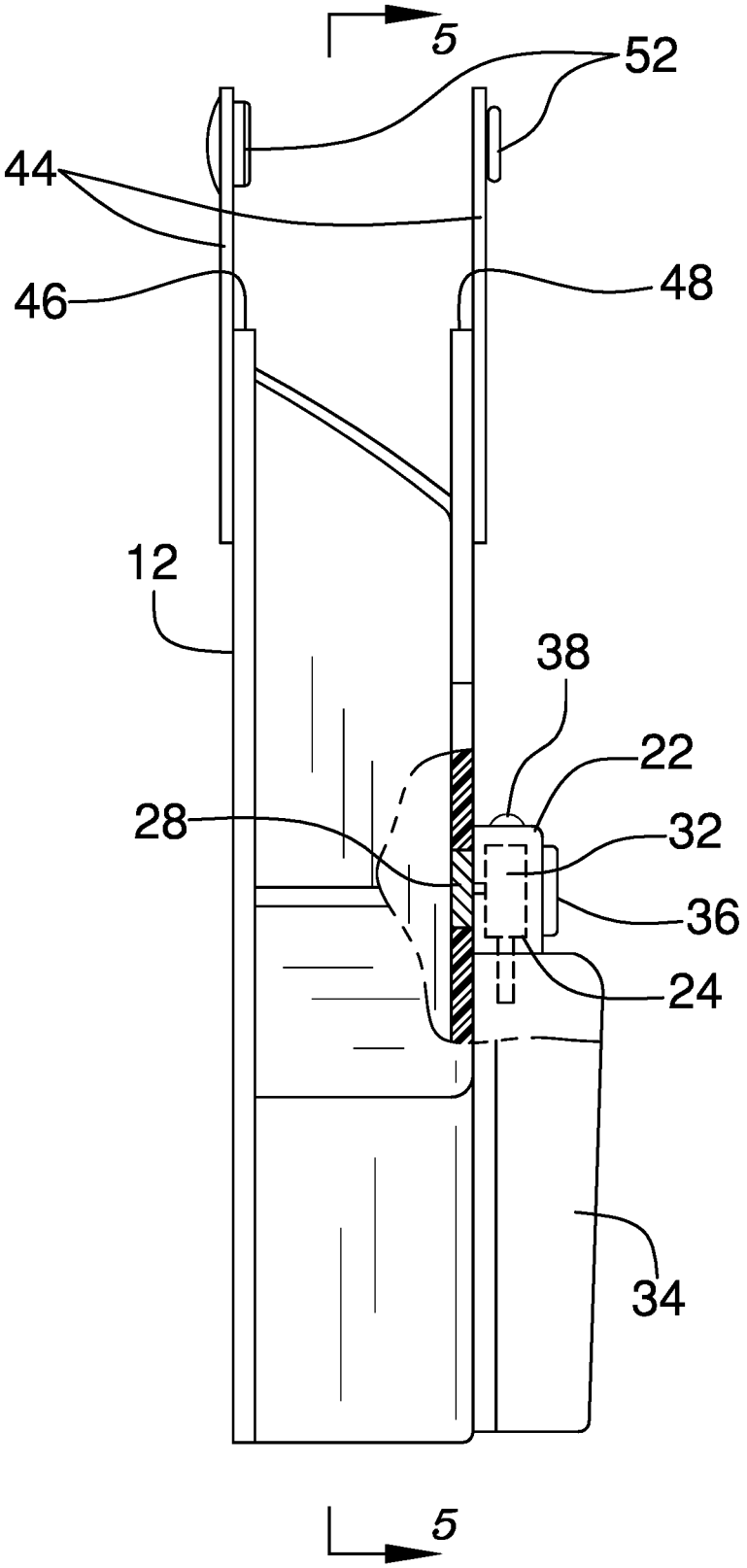
FIG. 3 is a side view of an embodiment of the disclosure.
Figure 4:
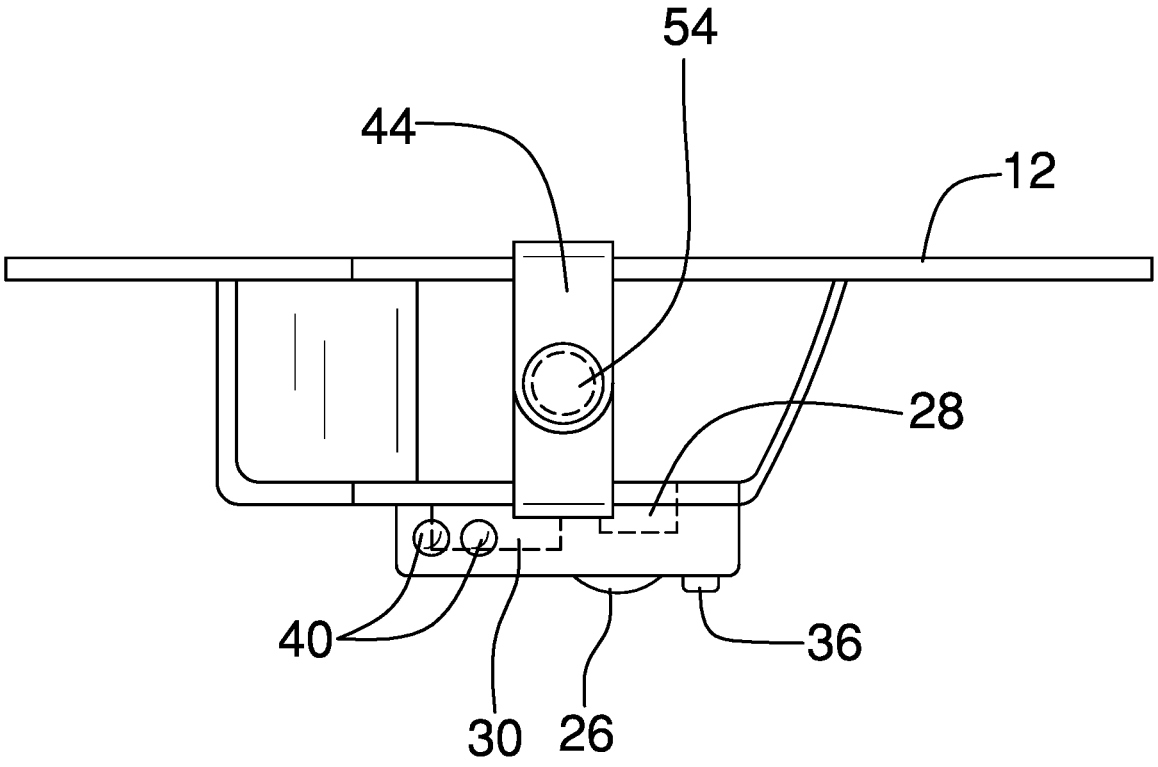
FIG. 4 is a top view of an embodiment of the disclosure.
Figure 5:
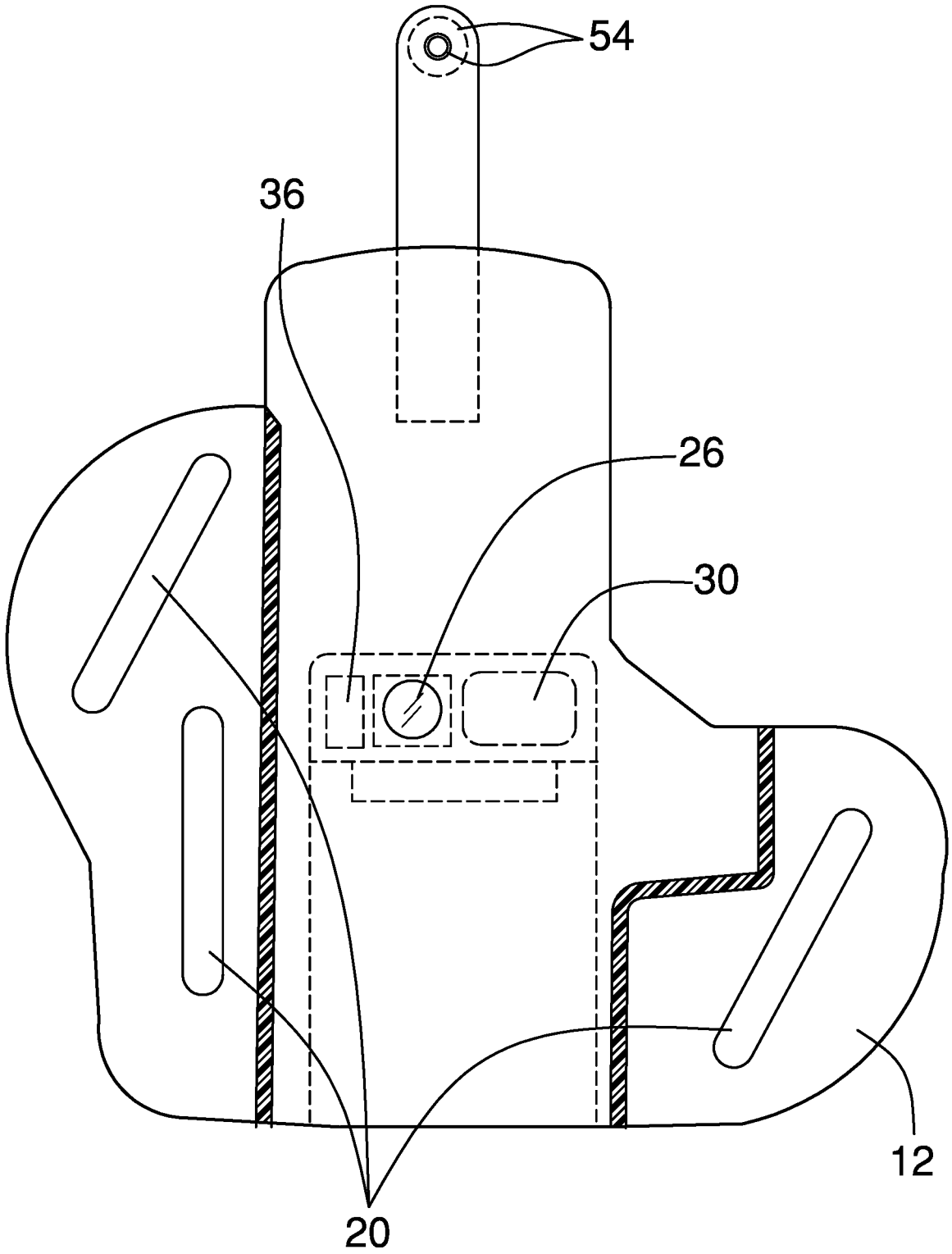
FIG. 5 is a cross-sectional view of an embodiment of the disclosure.
Figure 6:
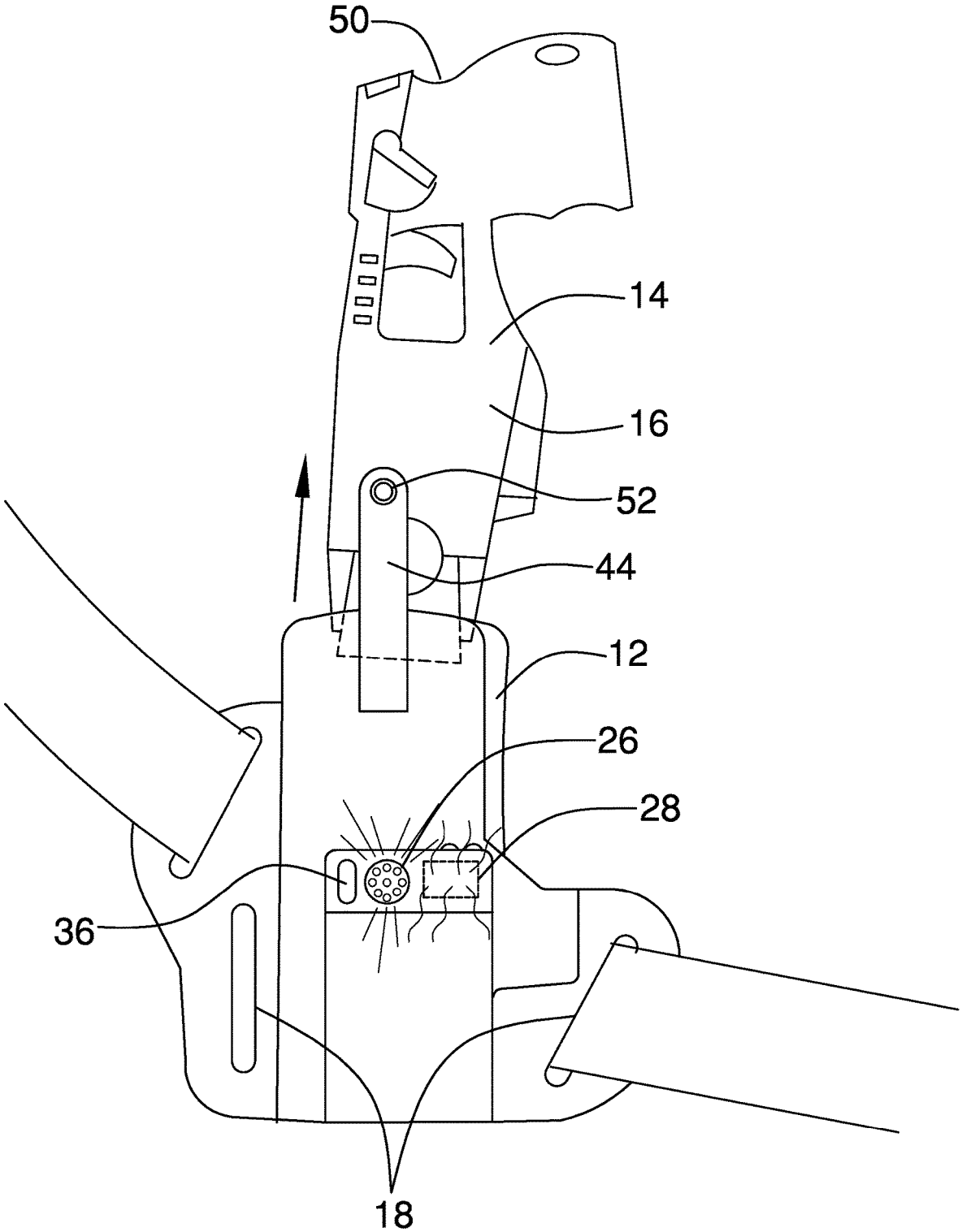
FIG. 6 is an in-use view of an embodiment of the disclosure.
Figure 7:
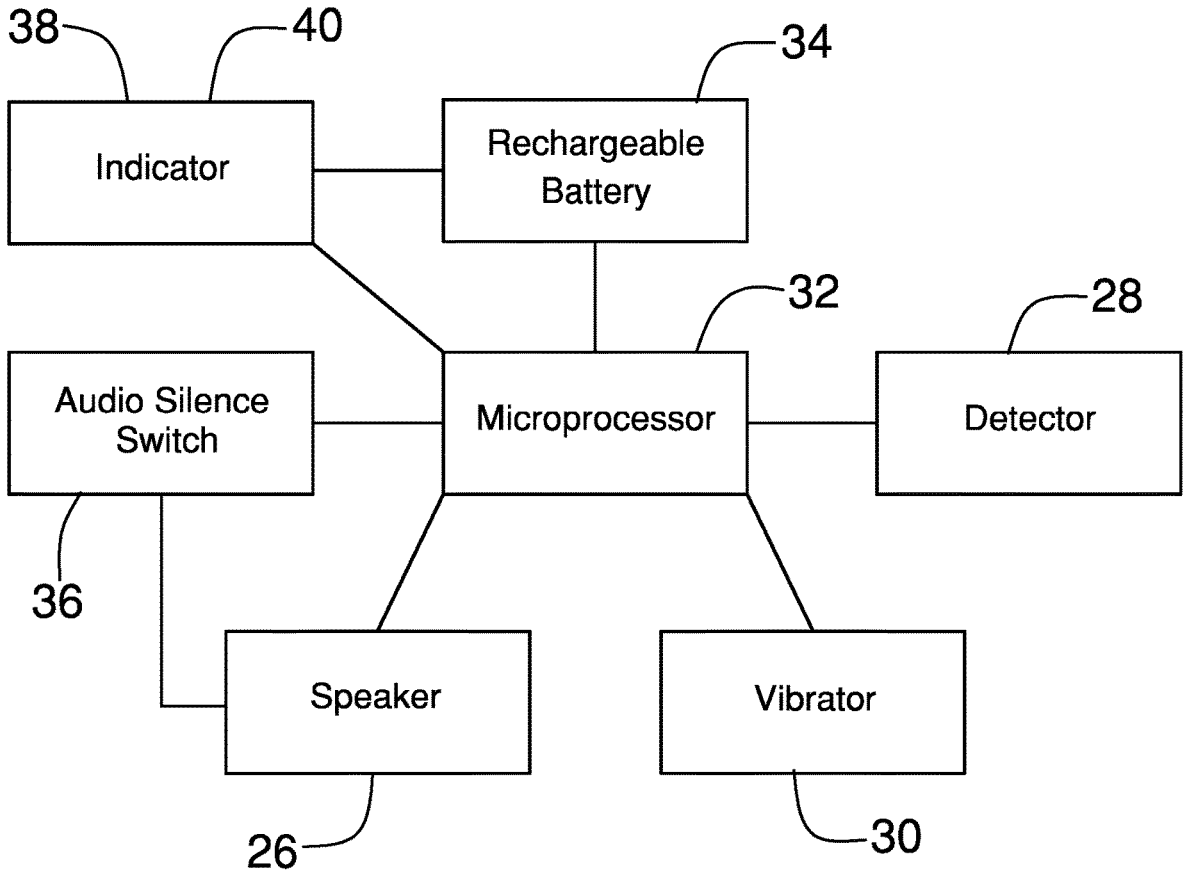
FIG. 7 is a block diagram of an embodiment of the disclosure.
Figure 8:
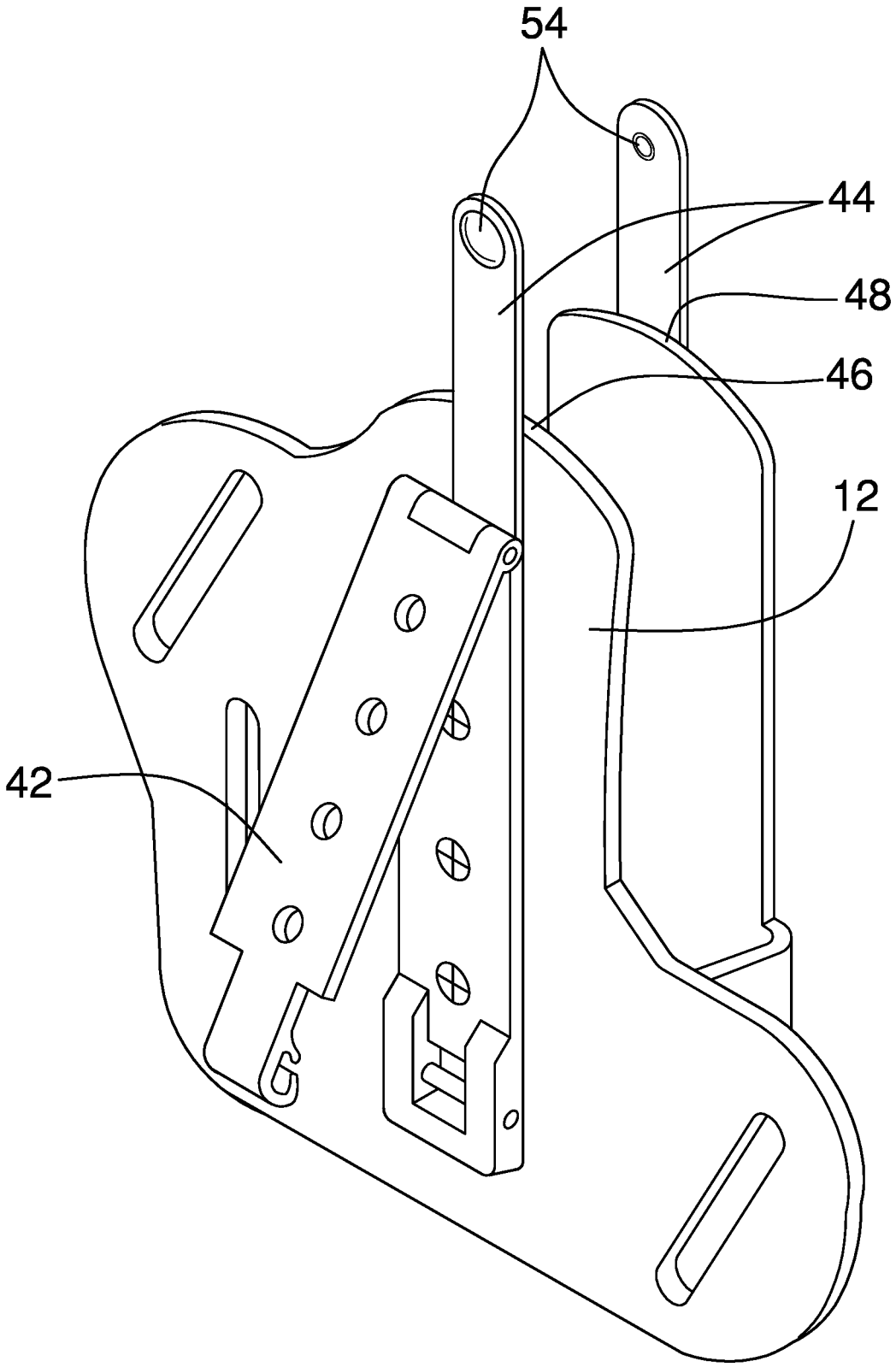
FIG. 8 is an isometric perspective view of an embodiment of the disclosure.

With reference now to the drawings, and in particular to FIGS. 1 through 8 thereof, a new holstering device embodying the principles and concepts of an embodiment of the disclosure and generally designated by the reference numeral 10 will be described.

As best illustrated in FIGS. 1 through 8, the draw alerting weapon holstering device 10 generally comprises a holster 12, which is configured for insertion of a weapon 14. The holster 12 also is configured to engage either a user or an article that is engaged to the user so that the holster 12 and the weapon 14 are engaged to the user. The weapon 14 comprises an electroshock weapon 16, a handgun (not shown), or the like.

A connector 18 is engaged to the holster 12. The connector 18 may comprise a plurality of slots 20, which are configured for insertion of a belt to engage the holster 12 to the user. The connector 18 also may comprise a fastener 42, shown in FIG. 8, which is configured to selectively engage modular lightweight load-carrying equipment webbing (MOLLE webbing, not shown) to engage the holster 12 to the MOLLE webbing. The present invention also anticipates the connector 18 comprising other connecting means suitable for belt holsters, tactical thigh holsters, shoulder holsters, chest holsters, and the like.

A housing 22 is selectively engageable to or integral to the holster 12. The housing 22 defines an interior space 24. As shown in FIG. 1, the housing 22 is integral to the holster 12. A speaker 26 and a detector 28 are engaged to the housing 22. The detector 28 is configured to detect a weapon 14 when it is positioned in the holster 12. The detector 28 may comprise a proximity sensor, a force-sensing resistor, or the like.

A vibrator 30 and a microprocessor 32 are engaged to the housing 22 and are positioned in the interior space 24. The microprocessor 32 is communicatively engaged to the speaker 26, the detector 28, and the vibrator 30. A battery 34 which is rechargeable, is selectively engageable to the housing 22 so that it is operationally engaged to the microprocessor 32.

The detector 28 is enabled to signal the microprocessor 32 upon drawing of the weapon 14 from the holster 12, positioning the microprocessor 32 to selectively signal the speaker 26 and the vibrator 30 to broadcast an audible alert and to initiate a vibratory alert, respectively. The present invention is anticipated to be of particular use to persons, such as law enforcement officers, who often carry both electroshock weapons 16 and handguns. Unfortunately, stressful interactions between law enforcement officers and subjects can lead to confusion on the part of the law enforcement officer as to which weapon 14 is drawn and used, leading to either excessive or insufficient force being used with the subject. Training with the present invention can reduce the likelihood of weapon 14 confusion and resultant injury to one or both of the law enforcement officer and the subject.

A switch 36 is engaged to the housing 22 and is operationally engaged to the microprocessor 32. The switch 36 is configured to be switched to signal the microprocessor 32 to deactivate the speaker 26 so that an audible alert is not broadcast upon drawing of the weapon 14 from the holster 12. The switch 36 is anticipated to be useful to a law enforcement officer who requires stealth in a particular situation.

An indicator 38 is engaged to the housing 22 and operationally engaged to the microprocessor 32. The microprocessor 32 can selectively actuate the indicator 38 to indicate a charge state of the battery 34. The indicator 38 may comprise a pair of light emitting diodes 40, or other indicating means, such as, but not limited to, display panels, light bars, and the like.

Each of a pair of straps 44 is engaged to and extends from a respective one of a top inside edge 46 and a top outside edge 48 of the holster 12. The straps 44 are extendible across a grip 50 of the weapon 14 upon insertion of the weapon 14 into the holster 12. A pair of couplers 52 is engaged singly to the straps 44 distal from the holster 12. The couplers 52 are selectively mutually couplable to connect the pair of straps 44 over the grip 50. The pair of straps 44 thus is configured to secure the weapon 14 in the holster 12. The pair of couplers 52 may comprise a snap fastener 54, or other fastening means, such as, but not limited to, magnets, hook and loop fasteners, and the like.

In use, the holster 12 is engaged either to the user or to an article that is engaged to the user. A weapon 14 is inserted into the holster 12. The detector 28 signals the microprocessor 32 upon drawing of the weapon 14 from the holster 12, whereupon the microprocessor 32 selectively signals the speaker 26 and the vibrator 30 to broadcast an audible alert and to initiate a vibratory alert, respectively.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A draw alerting weapon holstering device comprising:

a holster configured for insertion of a weapon and for engaging either a user or an article engaged to the user, such that the holster and the weapon are engaged to the user;

a housing selectively engageable to or integral to the holster, the housing being positioned on an outside surface wherein the holster is configured for being positioned between the housing and the user or the article engaged to the user;

a detector engaged to the housing and being configured for detecting a weapon positioned in the holster;

a speaker engaged to the housing;

a vibrator engaged to the housing and positioned in an interior space defined by the housing;

a battery selectively engageable to the housing, the battery being slidably engageable to the housing such that the battery is configured for being disengageable from the housing without removing the holster from the user or the article engaged to the user; and a microprocessor engaged to the housing and positioned in the interior space, the microprocessor being operationally engaged to the battery, the microprocessor being communicatively engaged to the vibrator, the speaker, and the detector, such that the detector is enabled for signaling the microprocessor upon drawing of the weapon from the holster, positioning the microprocessor for selectively signaling the speaker and the vibrator for broadcasting an audible alert and for initiating a vibratory alert, respectively.

2. The draw alerting weapon holstering device of claim 1, further including a connector engaged to the holster, the connector comprising:

a plurality of slots configured for insertion of a belt; or a fastener configured for selectively engaging modular lightweight load-carrying equipment webbing.

3. The draw alerting weapon holstering device of claim 1, wherein the detector comprises a proximity sensor or a force-sensing resistor.

4. The draw alerting weapon holstering device of claim 1, wherein the battery is rechargeable.

5. The draw alerting weapon holstering device of claim 1, further including a switch engaged to the housing and operationally engaged to the microprocessor, wherein the switch is configured for switching for signaling the microprocessor for deactivating the speaker, such that an audible alert is not broadcast upon drawing of the weapon from the holster.

6. The draw alerting weapon holstering device of claim 5, further including an indicator engaged to the housing and operationally engaged to the microprocessor, positioning the microprocessor for selectively actuating the indicator for indicating a charge state of the battery.

7. The draw alerting weapon holstering device of claim 6, wherein the indicator comprises a pair of light emitting diodes.

8. The draw alerting weapon holstering device of claim 6, wherein the housing is integral to the holster.

9. The draw alerting weapon holstering device of claim 1, further including a pair of straps, each strap being engaged to and extending from a respective one of a top inside edge and a top outside edge of the holster, such that the straps are extendible across a grip of the weapon upon insertion of the weapon into the holster; and a pair of couplers engaged singly to the straps distal from the holster, the couplers being selectively mutually couplable for connecting the pair of straps over the grip, wherein the pair of straps is configured for securing the weapon in the holster.

10. The draw alerting weapon holstering device of claim 9, wherein the pair of couplers comprises a snap fastener.

11. A draw alerting weapon holstering system comprising:

a holster configured for engaging either a user or an article engaged to the user;

a weapon inserted into said holster, such that the holster and the weapon are engaged to the user;

a housing selectively engageable to or integral to the holster, the housing being positioned on an outside surface wherein the holster is configured for being positioned between the housing and the user or the article engaged to the user;

a detector engaged to the housing and being configured for detecting the weapon positioned in the holster;

a speaker engaged to the housing;

a vibrator engaged to the housing and positioned in an interior space defined by the housing;

a battery selectively engageable to the housing, the battery being slidably engageable to the housing such that the battery is configured for being disengageable from the housing without removing the holster from the user or the article engaged to the user; and a microprocessor engaged to the housing and positioned in the interior space, the microprocessor being operationally engaged to the battery, the microprocessor being communicatively engaged to the vibrator, the speaker, and the detector, such that the detector is enabled for signaling the microprocessor upon drawing of the weapon from the holster, positioning the microprocessor for selectively signaling the speaker and the vibrator for broadcasting an audible alert and for initiating a vibratory alert, respectively.

12. The draw alerting weapon holstering system of claim 11, wherein the weapon comprises an electroshock weapon or a handgun.

13. A draw alerting weapon holstering device comprising:

a holster configured for insertion of a weapon and for engaging either a user or an article engaged to the user, such that the holster and the weapon are engaged to the user;

a connector engaged to the holster, the connector comprising a plurality of slots configured for insertion of a belt or a fastener configured for selectively engaging modular lightweight load-carrying equipment webbing;

a housing selectively engageable to or integral to the holster, the housing being positioned on an outside surface wherein the holster is configured for being positioned between the housing and the user or the article engaged to the user;

a detector engaged to the housing and being configured for detecting a weapon positioned in the holster, the detector comprising a proximity sensor or a force-sensing resistor;

a speaker engaged to the housing;

a vibrator engaged to the housing and positioned in an interior space defined by the housing;

a battery selectively engageable to the housing, the battery being slidably engageable to the housing such that the battery is configured for being disengageable from the housing without removing the holster from the user or the article engaged to the user, the battery being rechargeable;

a microprocessor engaged to the housing and positioned in the interior space, the microprocessor being operationally engaged to the battery, the microprocessor being communicatively engaged to the vibrator, the speaker, and the detector, such that the detector is enabled for signaling the microprocessor upon drawing of the weapon from the holster, positioning the microprocessor for selectively signaling the speaker and the vibrator for broadcasting an audible alert and for initiating a vibratory alert, respectively;

a switch engaged to the housing and operationally engaged to the microprocessor, wherein the switch is configured for switching for signaling the microprocessor for deactivating the speaker, such that an audible alert is not broadcast upon drawing of the weapon from the holster;

an indicator engaged to the housing and operationally engaged to the microprocessor, positioning the microprocessor for selectively actuating the indicator for indicating a charge state of the battery, the indicator comprising a pair of light emitting diodes;

a pair of straps, each strap being engaged to and extending from a respective one of a top inside edge and a top outside edge of the holster, such that the straps are extendible across a grip of the weapon upon insertion of the weapon into the holster; and a pair of couplers engaged singly to the straps distal from the holster, the couplers being selectively mutually couplable for connecting the pair of straps over the grip, wherein the pair of straps is configured for securing the weapon in the holster, the pair of couplers comprises a snap fastener.

* * * * *